United States Patent [19]

Bonner et al.

[11] Patent Number: 4,737,076

[45] Date of Patent: Apr. 12, 1988

[54] MEANS FOR MAINTAINING CONCENTRICITY OF ROTATING COMPONENTS

[75] Inventors: George A. Bonner, Palm Beach Gardens; Lee E. Hansen, Lake Park; Jack W. Wilson, Jr., West Palm Beach, all of Fla.

[73] Assignee: United Technologies Corporation, Hartford, Conn.

[21] Appl. No.: 921,039

[22] Filed: Oct. 20, 1986

[51] Int. Cl.[4] ..... F01D 5/30

[52] U.S. Cl. ..... 416/198 A; 416/204 A; 416/244 A; 403/273; 403/372

[58] Field of Search ..... 416/198 A, 200 A, 244 A, 416/204 R, 204 A; 403/326, 338, 372, 365, 273

[56] References Cited

U.S. PATENT DOCUMENTS

| | | | |
|---|---|---|---|
| 1,593,393 | 7/1926 | Doran | 416/198 R |
| 1,873,956 | 8/1932 | Dahlstrand | 403/358 |
| 2,579,745 | 12/1951 | Lombard et al. | 416/244 A |
| 2,619,317 | 11/1952 | Traupel | 416/95 |
| 2,869,820 | 1/1959 | Marchant et al. | 416/201 R |
| 3,146,635 | 9/1964 | Brose | 416/244 A |
| 3,165,342 | 1/1965 | Anderson | 416/204 A |
| 3,671,140 | 6/1972 | Shank | 416/183 |
| 3,689,177 | 9/1972 | Klassen | 416/198 |
| 3,846,044 | 11/1974 | Shank | 416/199 |
| 3,888,602 | 6/1975 | Nichols et al. | 416/198 |
| 4,139,160 | 2/1979 | Rood | 403/372 |
| 4,183,719 | 1/1980 | Bozung | 416/244 A |
| 4,242,008 | 12/1980 | Bernasconi | 403/13 |
| 4,247,256 | 1/1981 | Maghon | 416/198 A |
| 4,468,148 | 8/1984 | Seymour | 403/259 |
| 4,573,875 | 3/1986 | Emeterio et al. | 416/198 A |
| 4,653,984 | 3/1987 | Robbins | 416/198 A |

FOREIGN PATENT DOCUMENTS

| | | | |
|---|---|---|---|
| 423465 | 4/1923 | Fed. Rep. of Germany | 416/204 |
| 67703 | 4/1985 | Japan | 415/198 A |

*Primary Examiner*—Robert E. Garrett
*Assistant Examiner*—John T. Kwan
*Attorney, Agent, or Firm*—Norman Friedland

[57] ABSTRACT

A cylindrically shaped spacer between a shaft and hub of a turbine rotor of a gas turbine engine as fabricated from a flexible resilient material and interference fitted at discrete points on either side of the transverse axis of the spacer between the shaft and spacer and between the hub and spacer to impart a twist of the spacer about this axis to remain in contact with the hub and shaft throughout its entire rotating envelope.

1 Claim, 1 Drawing Sheet

MEANS FOR MAINTAINING CONCENTRICITY OF ROTATING COMPONENTS

The Government has rights in this invention pursuant to a contract awarded by the Department of the Air Force.

DESCRIPTION

1. Technical Field

This invention relates to turbine rotor construction of a gas turbine engine and particularly to means for assuring intimate contact between this rotor and shaft during high rotational speed operation to achieve concentricity between these rotating components.

2. Background Art

Since the advent of high performance gas turbine engines, the rotational speed of the high pressure compressor/turbine spool has been significantly increasing. A problem incidental to the higher speeds, particularly where the rotor is splined to the shaft, the centrifugal loads tend to cause a separation between the shaft and rotor which typically creates an intolerable imbalance problem. While providing a tight fit to the relative parts affords one solution to this particular problem, as when one part is shrink fitted to the other, this solution is not deemed practical in certain applications or may be precluded by the assembly of the parts.

DISCLOSURE OF INVENTION

Accordingly, an object of the invention is to provide means to maintain concentricity of two rotating parts by a flexible spacer mounted therebetween. The flexible spacer is a radial spring that is discretely mounted and judiciously sized so that two interference fits are designed at axially spaced locations, one between the inner diameter of the spacer and one of the rotating parts, and the other between the outer diameter of the spacer and the other rotating part. The interference fits cause the spacer to deform in a radial manner about the transverse axis.

Other features and advantages will be apparent from the specification and claims and from the accompanying drawings which illustrate an embodiment of the invention.

BEST MODE FOR CARRYING OUT THE INVENTION

Figures 1, 2:
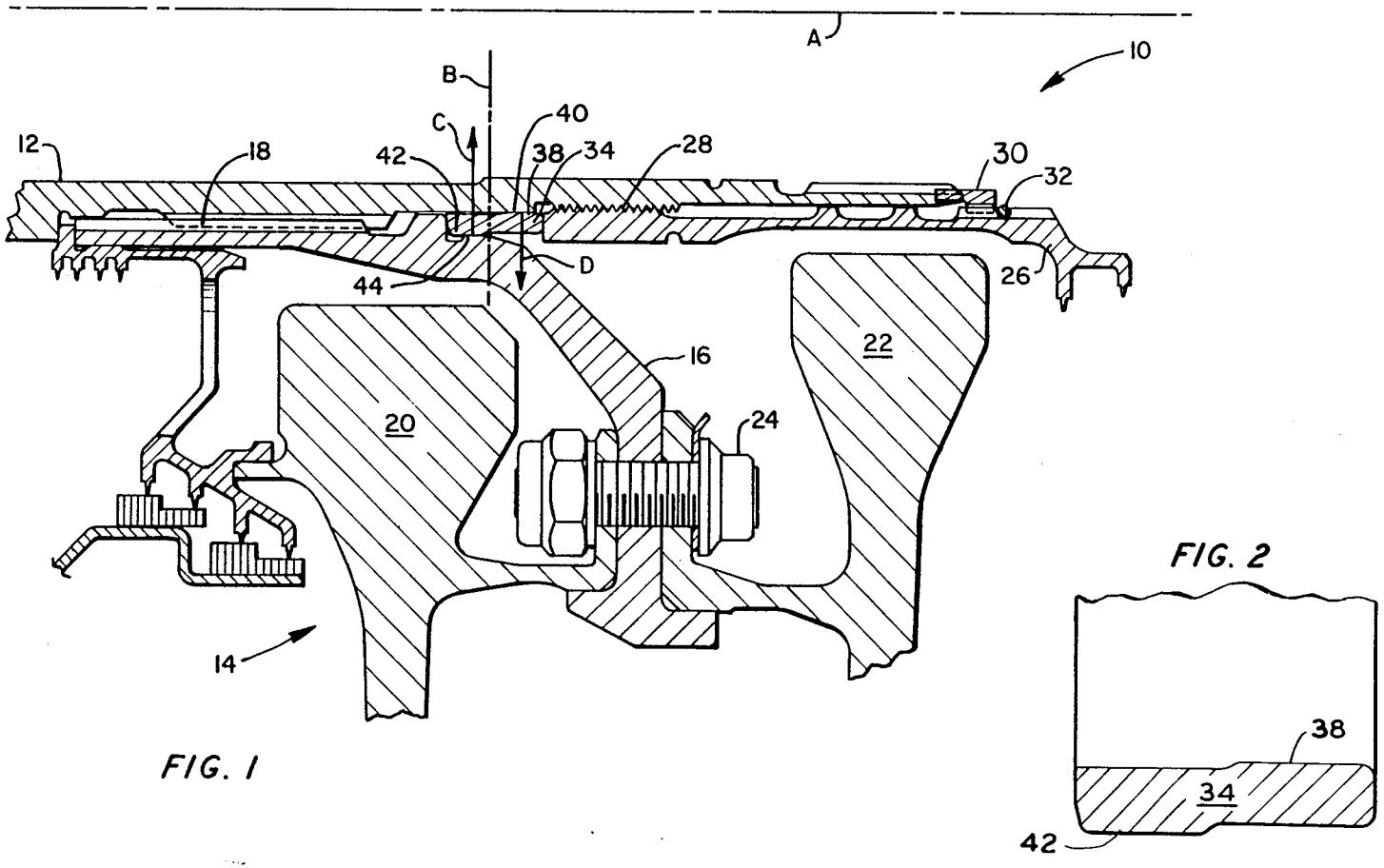
FIG. 1 is a partial view in section of the turbine section of a gas turbine engine showing the details of the invention and FIG. 2 is an exploded view in section illustrating the spacer.

For the sake of simplicity and convenience only that portion of the invention that is necessary for an understanding is disclosed herein and further details to the construction of a typical gas turbine engine where this invention has utility reference should be made to the F100 engine manufactured by Pratt & Whitney Aircraft, a division of United Technologies Corporation, the assignee of this patent application. It should also be understood that the invention, as one skilled in this art would appreciate, has utility for any high speed rotational device where components have the tendency of separating at the higher speed conditions.

Referring to the sole figure, the turbine section of a gas turbine engine is generally illustrated by reference numeral 10 comprising shaft 12 rotatable about the centerline A and the rotor generally illustrated by reference numeral 14. The rotor comprises hub 16 drivingly connected to shaft 12 by the spline connection 18 and rotatably supports the disks 20 and 22 of the turbines (only partially shown). The disks are suitably attached to the hub by a plurality of circumferentially spaced nut and bolt assemblies 24 (only one being shown). Elongated nut 26 suitably threaded to the threads 28 formed on the outer diameter of shaft 12 secures the rotor to the hub so that the entire assembly is rigidly supported for rotary movement. The assembly may employ a key lock 30 splined to nut 26 with a projection end inserted into a complementary slot in the end of shaft 12. A wire lock 32 is retained in an annular slot formed on the inner diameter of shaft 26 secure the key from becoming dislodged.

According to this invention elongated spacer 34 formed from a suitable metallic alloy that is capable of operating in the hostile environment of the hot section of a gas turbine engine is characterized as being flexible and resilient so that it behaves similar to a spring. The spacer 34 is designed to have two interference fits, one with shaft 12 and the other with hub 16, so that it is in intimate contact with the two rotating components on assembly and as will be appreciated from the description to follow, will remain that way during the entire operating range of the assembly.

In the preferred embodiment as noted from FIGS. 1 and 2 the spacer 34 is dimensioned so that a portion 38 on the inner diameter projects radially inwardly to mate with the outer surface 40 of shaft 12 and that a portion 42 on the outer diameter of spacer 34 projects radially outward to bear against the mating surface 44 and inner diameter of hub 16. The spacer 34 is, hence, tightly fitted on the inner diameter to one of the rotating parts and on the outer diameter to the other rotating part.

As is apparent from the foregoing, the interference fits are disposed on either side of the transverse axis B which has the tendency of twisting the spacer around this axis in the manner illustrated by the arrows C and D. During operation, as the rotational speed increases, the hub 16 moves away from shaft 12 and the spacer, which behaves like a spring, has sufficient preload that it tends to untwist so as to maintain contact between the hub and shaft throughout the entire operating envelope. This serves to absorb any motion between the hub and shaft and prevent or minimize vibrations which would otherwise occur.

By virtue of this invention, a complex problem that has been persistent for a considerable time, has been solved by relatively simple means. The spacer maintains concentricity between the rotating parts to improve the operation and durability of the turbine.

It should be understood that the invention is not limited to the particular embodiments shown and described herein, but that various changes and modifications may be made without departing from the spirit and scope of this novel concept as defined by the following claims.

We claim:

1. A spacer for a shaft and a rotating component rotatably connected to each other for unitary rotation, said spacer being generally cylindrically shaped and hollow to surround said shaft and being disposed between said shaft and said rotating component and having a transverse axis, said spacer consisting of a first interference fit and a second interference fit, said first interference fit solely at a location on the spacer at one side of said transverse axis, said second interference fit solely at a location on the spacer at the opposing side of said transverse axis, said first interference fit between said spacer and said shaft, said second interference fit between said spacer and said rotating component for imparting a twisting load about said transverse axis, whereby said spacer tends to untwist upon an increase in rotational speed so as to maintain contact between said shaft and rotating component wherein said spacer has a thickened cross section at the first interference fit extending radially inward toward said shaft and a thickened cross section at the second interference fit extending radially outward toward said rotating component.

* * * * *